US005522183A

United States Patent [19]

Allen

[11] Patent Number: 5,522,183

[45] Date of Patent: Jun. 4, 1996

[54] LATERAL GUTTER SCREEN

[76] Inventor: David J. Allen, 18540 Main Blvd., Los Gatos, Calif. 95030

[21] Appl. No.: 380,963

[22] Filed: Jan. 31, 1995

[51] Int. Cl.[6] ..... E04D 13/04

[52] U.S. Cl. ..... 52/12; 52/11

[58] Field of Search ..... 52/11, 12, 15; 210/163, 153, 335, 232

[56] References Cited

U.S. PATENT DOCUMENTS 4,032,456 6/1977 Berce ..... 52/12 X

*Primary Examiner*—Kien T. Nguyen
*Attorney, Agent, or Firm*—Jeffrey A. Hall

[57] ABSTRACT

A gutter screen for for preventing leaves, pine needles, and other debris from clogging a longitudinally extending gutter comprises a first moveable leg adapted to slideably fit within a longitudinally extending gutter. The first moveable leg includes a plurality of spaced and sized aperture allowing the flow of water therethrough while preventing the passage of leaves, pine needles, and other debris. A second moveable leg adapted to be slideably fit within a longitudinally extending gutter includes a plurality of spaced and sized apertures. The second leg is hingedly secured to the first leg allowing movement of the first leg and the second leg in relation to each other permitting the gutter screen to be slideably secured within the longitudinally extending gutter while allowing the gutter screen to be folded and stored in a flat configuration.

11 Claims, 2 Drawing Sheets

LATERAL GUTTER SCREEN

BACKGROUND OF THE INVENTION

1. Field of Invention

This invention relates to gutter screens, and particularly to lateral gutter screens which do not hinder the longitudinal or transverse flow of water in the gutter or require the modification of the gutter or the supporting roof for installation, which are self-supporting, and which are essentially maintenance free.

2. Description of the Related Art

Various gutter screens and gutter guards have been proposed and implemented to prevent leaves and other debris from entering roof gutters and from blocking the flow of water therethrough. Although a large variety of gutter screens and guards have been developed, there exists significant problems and limitations with all prior screens and guards. Prior gutter guards and screen assemblies suffer from complications including significant limitations ill limiting intrusion by leaves and other debris, difficulty of installation and removal, and problems associated with blockage of water flow through the gutter in both the longitudinal and transverse directions.

Attempts to solve such problems in gutter screens and gutter guards have met with only limited success. For example, U.S. Pat. No. 5,103.601 issued to Hunt, shows a trilateral gutter guard with a first and second leg connected by a third horizontal leg and is representative of prior, albeit incomplete solutions to such problems. For example, the Hunt patent has two legs positioned at art angle which traps leaves and debris in between the legs and the screen, and restricts the flow of water when leaves and other debris are caught in between the legs and the gutter. Moreover, such gutter guards are extremely difficult to install, clean, and remove from gutters, and in fact are very limited in terms of the number and type of gutter in which they may be used. In fact, such limitations have undoubtedly been a reason such prior gutter screens and guards have not received widespread acceptance.

Accordingly, it is the primary object of this invention to provide a gutter guard which is highly effective at preventing leaves, pine needles, dirt, and other debris and organic matter form interfering with the flow of water through a gutter. It is another object of the present invention to provide a highly effective, easy to install, easy to clean, easy to remove, self-supporting, maintenance free, and inexpensive gutter screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purpose of the invention as embodied and broadly described herein, a lateral gutter screen is provided for preventing leaves, pine needles and other debris form entering a longitudinally extending roof gutter and blocking the flow of water therethrough. The gutter screen, in one embodiment, comprises a first moveable leg adapted to slideably fit within a longitudinally extending roof gutter.

The first leg includes a plurality of apertures allowing for the flow of water therethrough. A second moveable leg adapted to slideably fit within a longitudinally extending roof gutter includes a plurality of apertures. The second leg is hingedly secured to the first leg allowing movement of the first leg and the second leg in relation to each other and permitting the gutter screen to be slideably secured within the longitudinally extending gutter while allowing the gutter screen to be stored in a flat configuration. Preferably, the gutter screen presents a generally triangular cross section when positioned within a longitudinally extending gutter with a gutter wall forming the base of the triangle and the first leg and the second leg of the gutter screen forming the sides of the triangular cross section.

The gutter screen is preferably composed of any durable, resilient material, however, plastics, polyethylene, vinyl, rubber, and the like are preferred. The gutter screen of the present invention is very efficient in preventing leaves, pine needles and other debris form clogging a gutter, and is also very easy to install in the gutter or remove from the gutter, and is very inexpensive to manufacture. The gutter screen of the present invention may be used on all types of gutters without requiring modification of the gutter, roof, or structure to which the gutter is attached.

In accordance with the present invention there also is provided an improved lateral gutter screen for preventing debris form clogging a longitudinally extending gutter, comprising: a first foldable and moveable leg adapted to be slideably received within a longitudinally extending gutter. The first leg includes a plurality of selectively spaced and sized apertures therein allowing for a flow of water through the plurality apertures. A foldable and moveable second leg is adapted to be slideably held and secured within the longitudinally extending gutter and includes a plurality of spaced and sized apertures allowing for the flow of water therethrough. The second leg is hingedly secured to the first leg by a crease between the first leg and the second leg allowing the first and second leg to be moved and adjusted in relation to each other so as to be received and secured within the longitudinally extending gutter and to be folded flat for storage so that said first and said second leg extend from one another in an essentially horizontal plane.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in tile accompanying drawings.

In accordance with the present invention, there is provided a gutter screen comprising: a first moveable leg adapted to slideably fit within a longitudinally extending gutter; said first leg including a plurality of apertures therein allowing for a flow of water through said plurality of apertures; and a second moveable leg adapted to slideably fit within said longitudinally extending gutter: said second leg including a plurality of spaced apertures allowing the flow of water through said plurality of apertures; said second leg being hingedly secured to said first leg allowing movement of said first leg and said second leg in relation to each other permitting said gutter screen to be slideably secured within the longitudinally extending gutter while allowing the gutter screen to be stored in a flat configuration. Preferably, the gutter screen presents a generally triangular cross section when positioned within a longitudinally extending gutter with a gutter wall forming the base of the triangle and the first and the second leg of the gutter screen forming the sides of the triangular cross section.

Figure 1:
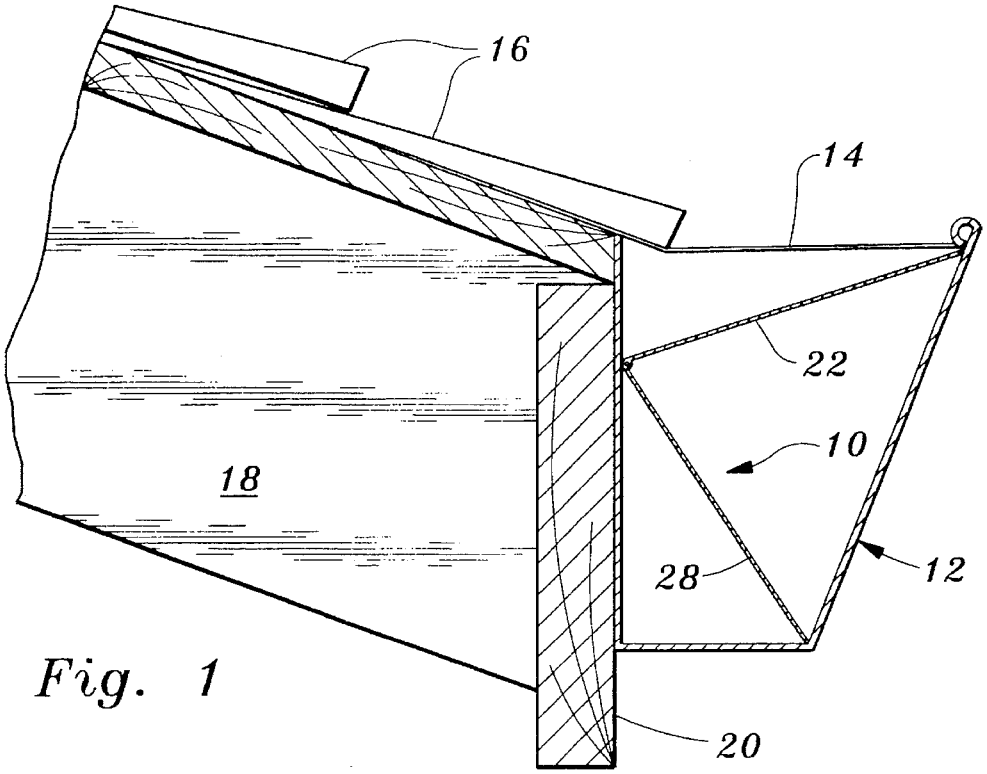
FIG. 1 is an end view of a lateral gutter screen shown positioned in a longitudinally extending gutter, according to the invention.
Figure 2:
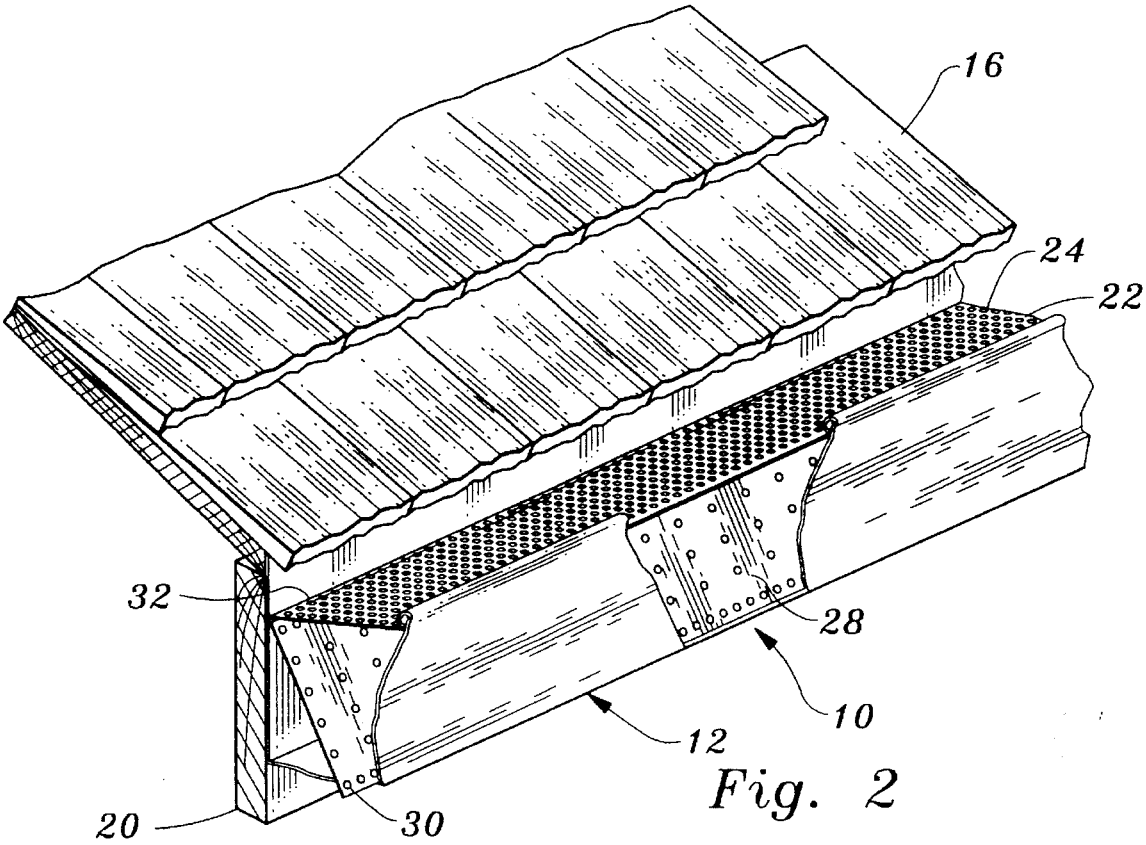
FIG. 2 is a side perspective view of such gutter screen, according to the invention.

In FIG. 1, a lateral gutter screen 10 is shown according to a preferred embodiment of the invention. Gutter screen 10 is shown in FIG. 1 positioned in a longitudinally extending gutter 12 with gutter straps 14 secured to shingles 16. Gutter 12 is shown as typically secured to a house with facia board 20, and rafters 18. Gutter screen 10 prevents leaves, pine needles, and other debris from entering gutter 12 and blocking or clogging the flow of water therethrough. Gutter screen 10 preferably includes a first moveable leg 22 adapted to be slideably fit within gutter 12 having a plurality of spaced and selectively positioned and sized apertures 24 allowing for a flow of water through the plurality of apertures 24 so water may enter the gutter essentially unimpeded while leaves, pine needles, and other debris are prevented from entering gutter 12. Apertures 24 are preferably spaced at about ¼ inch apart from one another and are about 5/16 inches in diameter, however, other spacing and sizing may also be used. Apertures 24 are preferably spaced at least ¼ inches from the edge of gutter screen 10 and at least ¼ inch from hinge or crease 32, of course, other spacing and distancing is also possible. As seen in FIG. 1, apertures 24 on first leg 22 may be arranged in linear rows, such as row 26, clustered, or otherwise. First leg 22 is preferably composed of a durable, resilient material, such as plastic, vinyl, polyethylene, rubber, or the like, thereby providing a firm yet flexible screen.

Figure 3:
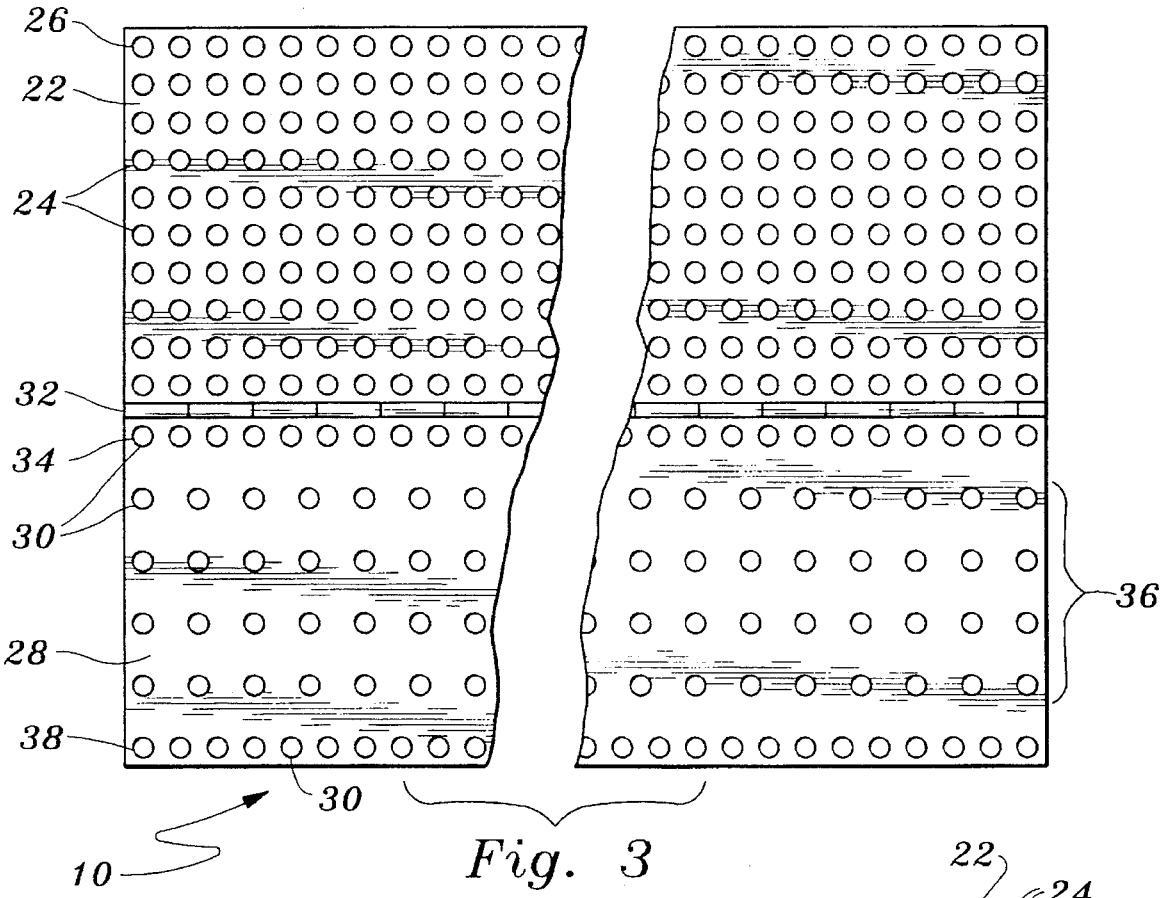
FIG. 3 is a top view of such gutter screen shown folded flat, according to the invention.
Figure 4:
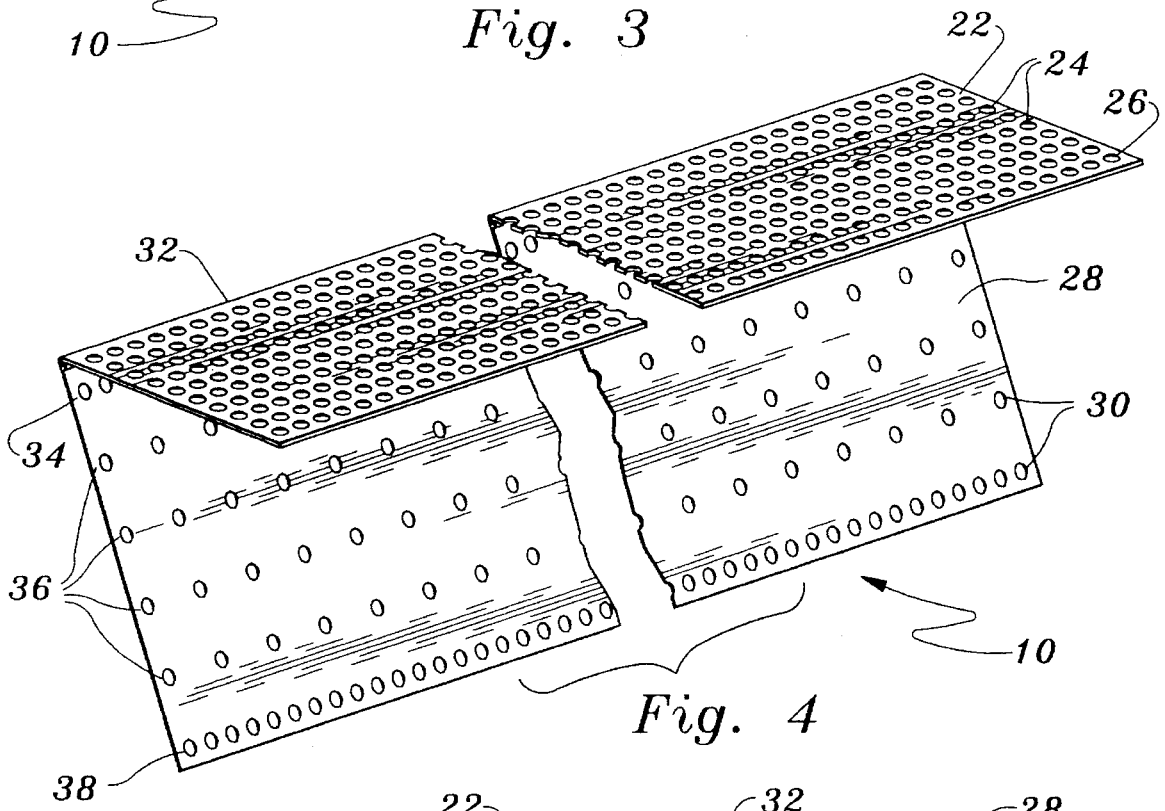
FIG. 4 is a front perspective view of such gutter screen, according to the invention.
Figure 5:
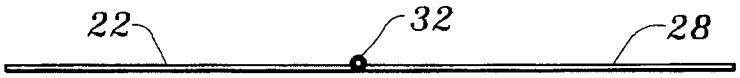
FIG. 5 shows an end view of such gutter screen in a flat configuration showing hinge 32, according to the invention.

In FIGS. 1–5 a second moveable leg 28 is shown adapted to slideably fit within gutter 12 and includes a plurality of selectively sized and positioned apertures 30. Second leg 28 is hingedly secured to first leg 22 allowing for movement of first leg 22 and second leg 28 in relation to each other permitting gutter screen 10 to be slideably secured and positioned within gutter 12 or legs 22 and 28 may be folded flat allowing gutter screen 10 to be stored in a flat configuration. As seen in FIG. 1, gutter screen 10 preferably present a generally triangular cross section when positioned within a longitudinally extending gutter such as gutter 12 with a gutter wall forming the base of the triangle and first leg 22 and second leg 28 forming the sides of the triangular cross section. Second leg 28, as first leg 22, is preferably composed of a durable, resilient material, such as, plastic vinyl, polyethylene, rubber or the like, or may be made from a wire mesh or screen. In the preferred embodiment, gutter screen 10 with legs 22 and 28 is preferably made with vinyl of about 0.040 inches in thickness. However, other materials as mentioned may be used, and different thicknesses, for example, from about 0.020 inches to 0.070 inches may be used. However, 0.040 inches in thickness is preferred. By using the same size apertures in first leg 22 a maximum amount of water is allowed to pass through first leg 22, while preventing leaves, pine needles, and other debris from passing through screen 10. Second leg 28 and first leg 22 are hingedly secured together by hinge 32, which is preferably a crease connecting first leg 22 and second leg 28. That is, in the preferred embodiment, gutter screen 10 is a one-piece screen with first leg 22 and second leg 28 hingedly connected by crease 32 allowing for the movement and folding of first leg 22 and second leg 28 as shown in FIGS. 1–4, or folded flat as seen in FIG. 5. Of course, in alternative embodiments, first leg 22 and second leg 28 may be hingedly connected together by other means, such as a hinge, or configured in a cross-sectional U-shape without a hinge or crease with the first and the second leg forming a continuous curve shaped screen, however, such configurations are, in most applications, more expensive, difficult to install, and less efficient.

In reference to FIG. 3, first leg 22 is shown with plurality of apertures 24 which are preferably spaced about one-quarter inch apart and sized at 5/16 inch in diameter. However, other spacing of aperture 24 are clearly possible, such as clusters, or other geometrical arrangements, and different size holes may also be used, albeit with less efficiency, such as ¼ inch diameter. ½ inch diameter, or ¾ inch diameter apertures, for example. Second leg 28 preferably is configured with plurality of apertures 30 being positioned and grouped in three linear groupings, 34, 26, and 38 as shown. Apertures 34 are preferably grouped and arrange to permit water to pass through and into gutter 12. Apertures 36 is another preferred grouping of apertures in second leg 28 and, are preferably about 5/16 inches in diameter and spaced at about ¾ inch from one another. Of course, other spacing and size apertures may be used, however, the above spacing and dimensions being preferred. Apertures 38 are preferably of the same diameter as apertures 36, however, they are preferably spaced closer together than apertures 36. In this arrangement, water is permitted to flow through first leg 22 and second leg 28, however, any leaves, pine needles, or other debris are prevented from entering and clogging or blocking gutter 12.

In reference to FIG. 4, gutter screen 10 is shown with first leg 22 and second leg 28 in a typical configuration for sliding into a gutter. Although a wide variety of dimensions and sizes of gutter screen 10 may be provided, a typical size for residential applications would be with first leg 22 about 4⅛ inches in width and second leg 28 about 3⅞ inches in width. Lengths of gutter screen 10 of about 4 feet in length are also convenient, with segments being joined with clips, ties, or other fastening means well known in the art. Of course other widths of first leg 22 and second leg 28 may be provided if desired, as well as different lengths of gutter screen 10.

In operation and use, gutter screen 10 is extremely efficient at preventing leaves, pine needles, and other debris from entering and clogging or blocking gutters. Gutter screen 10 is very easy to install with lengths simply being slid into a guitar and either clipped, tied, or otherwise fastened together. Gutter screen 10 allows for water to both enter and flow within a gutter allowing both longitudinal and transverse flow without hindrance while preventing the entrance of leaves and debris. Gutter screen 10, once installed in a gutter is extremely easy to clean and remove. Moreover, gutter screen 10 may be used with any type or style of gutter such as fascia style gutters, plastic gutters, vinyl gutters, metal gutters, or wood gutters, without modification of the gutter or the supporting structure.

As is evident from the above description, the gutter screen 10 is both highly versatile and effective, while being inexpensive to manufacture and install. Additional advantages and modification will therefore readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A gutter screen system, comprising:

a longitudinally extending gutter, a first moveable leg slideably fit within said longitudinally extending gutter, said first leg including a plurality of apertures therein allowing for a flow of water through said plurality of apertures; and a second moveable leg slideably fit within the longitudinally extending gutter, said second leg including a plurality of spaced apertures of the same diameter, said plurality of spaced apertures being arranged in rows allowing the flow of water through said plurality of apertures; said second leg being hingedly secured to said first leg allowing movement of said first leg and said second leg in relation to each other permitting said gutter screen to be slideably secured within the longitudinally extending gutter while allowing the gutter screen to be stored in a flat configuration.

2. The gutter screen system of claim 1, wherein said second moveable leg is hingedly secured to said first moveable leg by a crease operably extending between said first moveable leg and said second moveable leg, allowing movement and positioning of said first moveable leg and said second moveable leg.

3. The gutter screen system of claim 1, wherein said plurality of apertures on said first moveable leg comprise a greater number of apertures than said plurality of aperatures on said second moveable leg.

4. The gutter screen system of claim 1, wherein said first leg and said second leg are composed of vinyl.

5. The gutter screen of claim 1, wherein said first leg and said second leg are composed of polyethylene.

6. The gutter screen of claim 1, wherein said first leg and said second leg are composed of vinyl 0.040 inches in thickness.

7. A lateral gutter screen system for preventing debris from clogging a longitudinally extending gutter, comprising:

a longitudinally extending gutter, a foldable and moveable first leg slideably received within said longitudinally extending gutter; said first leg including a plurality of selectively spaced and sized apertures therein allowing for a flow of water through said of plurality apertures; and a foldable and moveable second leg slideably held and secured within the longitudinally extending gutter; said second leg including a plurality of apertures having the same diameter and positioned in rows therein allowing for water to flow therethrough; said second leg being hingedly secured to said first leg by a crease between said first leg and said second leg allowing said first leg and second leg to be adjusted in relation to each other so as to be received and secured within the longitudinally extending gutter and to be folded flat for storage so that said first and said second leg extend from one another in an essentially horizontal plane.

8. The lateral gutter screen system of claim 7, wherein said plurality of spaced and sized aperture on said first leg comprise a greater number of apertures than said plurality of spaced and sized aperture on said second leg.

9. The lateral gutter screen of claim 7, wherein said first and said second leg are composed vinyl.

10. The lateral gutter screen of claim 7, wherein said first and said second leg are composed of polyethylene.

11. The lateral gutter screen of claim 7, wherein said first leg and said second leg are composed of vinyl 0.040 inches in thickness.

* * * * *